US009056455B2

(12) United States Patent
Suzuki et al.

(10) Patent No.: US 9,056,455 B2
(45) Date of Patent: Jun. 16, 2015

(54) LIQUID DISCHARGE DEVICE, TESTING METHOD, AND MEDIUM WITH RECORDED PROGRAM

(71) Applicant: SEIKO EPSON CORPORATION, Tokyo (JP)

(72) Inventors: Toshiyuki Suzuki, Nagano (JP); Osamu Shinkawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/334,796

(22) Filed: Jul. 18, 2014

(65) Prior Publication Data

US 2014/0327712 A1 Nov. 6, 2014

Related U.S. Application Data

(63) Continuation of application No. 13/488,896, filed on Jun. 5, 2012, now Pat. No. 8,783,821.

(30) Foreign Application Priority Data

Jun. 15, 2011 (JP) ..... 2011-133355

(51) Int. Cl.

| | |
|---|---|
| ***B41J 29/393*** | (2006.01) |
| ***B41J 2/045*** | (2006.01) |
| ***B41J 29/38*** | (2006.01) |
| *B41J 2/21* | (2006.01) |
| *B41J 11/00* | (2006.01) |
| *B41J 2/14* | (2006.01) |

(52) U.S. Cl.

CPC ..... *B41J 2/04501* (2013.01); *B41J 2/0451* (2013.01); *B41J 2/04555* (2013.01); *B41J 2/04581* (2013.01); *B41J 2/2135* (2013.01); *B41J 11/008* (2013.01); *B41J 29/38* (2013.01); *B41J 29/393* (2013.01); *B41J 2002/14354* (2013.01)

(58) Field of Classification Search

CPC ..... B41J 29/38; B41J 29/393; B41J 2/2135; B41J 11/008

USPC ..... 347/9, 14, 19, 20, 22, 23

See application file for complete search history.

(56) References Cited

U.S. PATENT DOCUMENTS

| | | | | |
|---|---|---|---|---|
| 7,429,093 | B2 * | 9/2008 | Shinkawa | 347/19 |
| 7,681,997 | B2 | 3/2010 | Kusunoki et al. | |
| 8,783,821 | B2 * | 7/2014 | Suzuki et al. | 347/19 |
| 2005/0212845 | A1 | 9/2005 | Shinkawa | |
| 2007/0103500 | A1 | 5/2007 | Ootsuka | |

FOREIGN PATENT DOCUMENTS

| | | | |
|---|---|---|---|
| JP | 2005-305992 | A | 11/2005 |
| JP | 2007-130853 | A | 5/2007 |

* cited by examiner

*Primary Examiner* — An Do

(74) *Attorney, Agent, or Firm* — Global IP Counselors, LLP

(57) ABSTRACT

There is provided a technique with which an abnormal discharge state in a discharge component can be determined on the basis of residual vibration. A printer includes a discharge component that discharges ink, a detector that detects residual vibration in the discharge component, and a tester that tests the discharge component on the basis of the change in the period of the residual vibration.

8 Claims, 8 Drawing Sheets

LIQUID DISCHARGE DEVICE, TESTING METHOD, AND MEDIUM WITH RECORDED PROGRAM

CROSS-REFERENCE TO RELATED APPLICATIONS

This application is a continuation application of U.S. patent application Ser. No. 13/488,896 filed on Jun. 5, 2012, now U.S. Pat. No. 8,783.821. This application claims priority to Japanese Patent Application No. 2011-133355 filed on Jun. 15, 2011. The entire disclosures of U.S. patent application Ser. No. 13/488,896 and Japanese Patent Application No. 2011-133355 are hereby incorporated herein by reference.

BACKGROUND

1. Technical Field

The present invention relates to a technique for testing a discharge component in a liquid discharge device.

2. Background Technology

An inkjet printer, which is a type of liquid discharge device, includes a plurality of discharge components for discharging ink. At each of these discharge components, ink is held in a cavity that communicates with a nozzle, and the ink is discharged from the nozzle by the drive of a drive element provided to the cavity. With the discharge components of such a liquid discharge device, if air bubbles become admixed into the ink in the cavity, or if the viscosity of the ink increases in the cavity, or if paper dust adheres to the nozzle, the nozzle can become clogged, and this can prevent the proper discharge of ink from the nozzle.

In the past, a technique has been proposed in which nozzle clogging (non-discharge state) in a discharge component is tested for on the basis of residual vibration remaining in the ink inside the cavity and caused by the drive of the drive element (see Patent Literature 1 and 2, for example).

Japanese Laid-open Patent Publication No. 2007-130853 (Patent Document 1) and Japanese Laid-open Patent Publication No. 2005-305992 (Patent Document 2) are examples of the related art.

SUMMARY

However, in the past there has not been enough study into using residual vibration as a basis for determining an abnormal discharge state in which the ink droplet position or droplet adhesion shape is different from that that under normal circumstances, even though ink can be discharged from the discharge component.

In light of the above problems, it is an advantage of the invention to provide a technique for allowing an abnormal discharge state of a discharge component to be determined on the basis of residual vibration.

The invention was conceived in order to solve at least some of the problems discussed above, and can be worked as the following modes or application examples.

APPLICATION EXAMPLE 1

The liquid discharge device in Application Example 1 includes a discharge component for driving a drive element to discharge a liquid contained in a cavity from a nozzle that communicates with the cavity, a detector for detecting vibration produced by the drive of the drive element, and a tester for testing the discharge component on the basis of the change in the period of the vibration. With the liquid discharge device of Application Example 1, it is possible to determine an abnormal discharge state of a discharge component in which there is a change in the period of the vibration as a result of driving the drive element. The vibration produced by drive of the drive element can be residual vibration of the drive element remaining after the drive of the drive element, or can be residual vibration of the liquid in the cavity remaining after the drive of the drive element.

APPLICATION EXAMPLE 2

The liquid discharge device of Application Example 1 can further include a maintenance component for servicing the discharge component according to the test result produced by the tester. With the liquid discharge device of Application Example 2, it is possible to deal with an abnormal discharge state in which there is a change in the period of the vibration as a result of driving the drive element.

APPLICATION EXAMPLE 3

With the liquid discharge device of Application Example 1 or 2, the tester can test the discharge component on the basis of the change in the period of the vibration from a first period to a second period that is longer than the first period. With the liquid discharge device of Application Example 3, it is possible to determine an abnormal discharge state attributable to the admixture of air bubbles.

APPLICATION EXAMPLE 4

With the liquid discharge device of any of Application Examples 1 to 3, the tester can test the discharge component on the basis of not only the change in the period of the vibration, but also the increase in the amplitude of the vibration during a change in the period of the vibration. With the liquid discharge device of Application Example 4, it is possible to reduce error in the determination of an abnormal discharge state attributable to the admixture of air bubbles.

APPLICATION EXAMPLE 5

With the liquid discharge device of any of Application Examples 1 to 4, the tester can test the discharge component on the basis of whether or not the changed period exceeds a second threshold, which is greater than a first threshold, after the period of the vibration has dropped below the first threshold. With the liquid discharge device of Application Example 5, it is possible to determine an abnormal discharge state attributable to the admixture of air bubbles.

APPLICATION EXAMPLE 6

With the liquid discharge device of any of Application Examples 1 to 5, the tester can test the discharge component on the basis of the change in the period of the vibration if the initial period in the vibration corresponds to a set period, and test the discharge component on the basis of the initial period if the initial period is different from the set period. With the liquid discharge device of Application Example 6, it is possible to reduce the processing load required by testing of the discharge component on the basis of vibration produced by the drive of the drive element.

APPLICATION EXAMPLE 7

The testing method of Application Example 7 is a testing method for testing a discharge component that drives a drive element to discharge a liquid contained in a cavity from a nozzle that communicates with the cavity, the method including a detection step of detecting vibration produced by the drive of the drive element, and a testing step of testing the discharge component on the basis of the change in the period of the vibration. With the testing method of Application Example 7, it is possible to determine an abnormal discharge state in which the period of vibration changes as a result of driving the drive element.

APPLICATION EXAMPLE 8

The program of Application Example 8 is a program that causes a computer to carry out a function of testing a discharge component that drives a drive element to discharge a liquid contained in a cavity from a nozzle that communicates with the cavity, the program carrying out a detection function of detecting vibration produced by the drive of the drive element, and a testing function of testing the discharge component on the basis of the change in the period of the vibration. With the program of Application Example 8, it is possible to determine an abnormal discharge state in which the period of vibration changes as a result of driving the drive element.

Modes of the invention are not limited to a liquid discharge device, a testing method, and a program, and the invention also can be applied to a specific mode of a liquid discharge device such as an inkjet printer, as well as to other modes such as a discharge device that discharges a fluid in a state in which a solid is dispersed in a liquid or a gas. The invention is not limited whatsoever by the above modes, and can of course be worked in various modes without departing from the gist of the invention.

BRIEF DESCRIPTION OF THE DRAWINGS

Referring now to the attached drawings which form a part of this original disclosure.

DETAILED DESCRIPTION OF EXEMPLARY EMBODIMENTS

A liquid discharge device to which the invention is applied will now be described in order to further clarify the constitution and action of the invention described above.

A. Working Example

Figure 1:
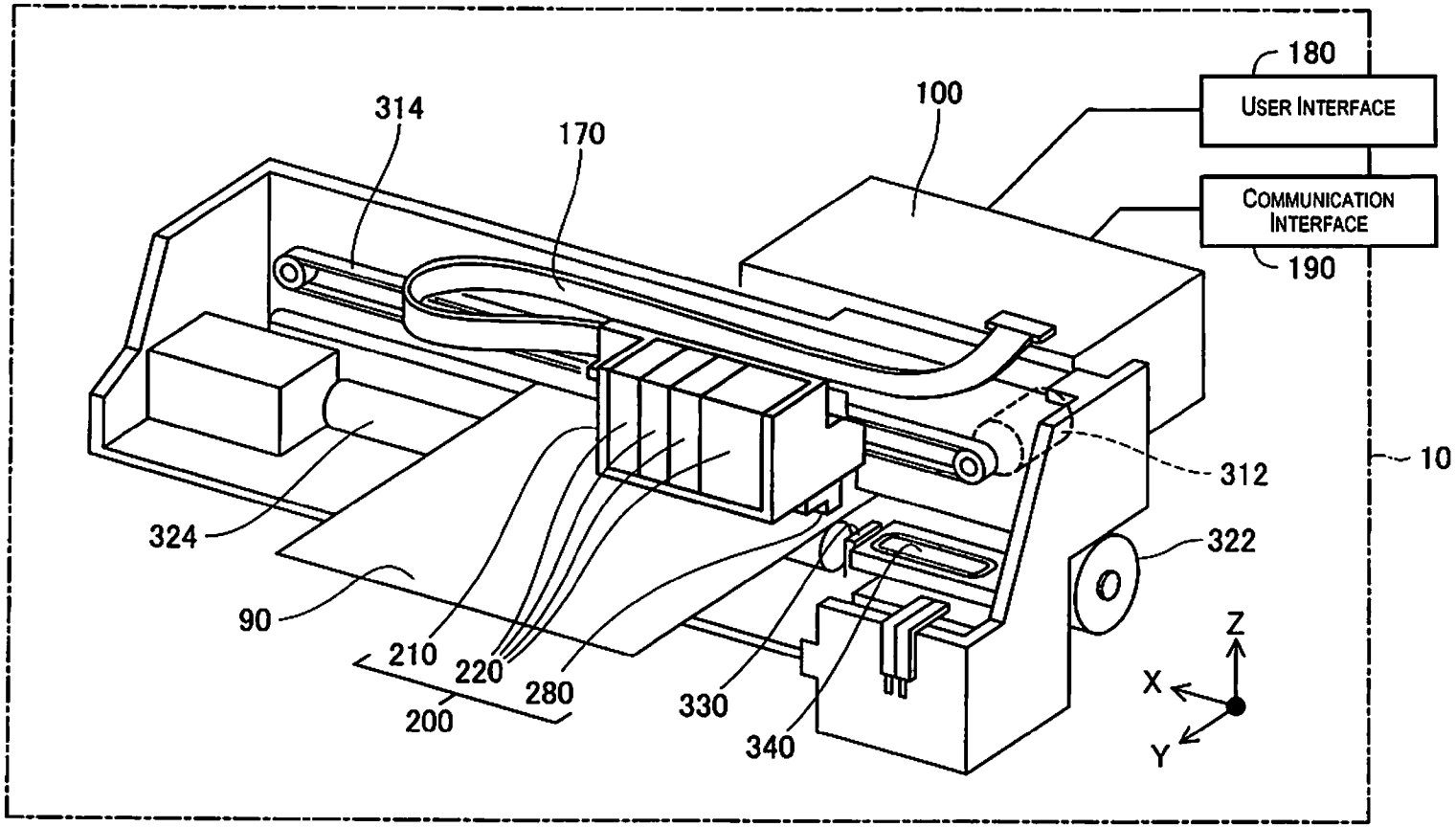
FIG. 1 is a diagram illustrating the configuration of a printer.

A1. Printer Configuration:

FIG. 1 is a diagram illustrating the configuration of a printer 10. The printer 10 is an inkjet printer, which is a liquid discharge device that discharges a liquid, and prints text, graphics, images, and other such data on paper, labels, or another such printing medium 90 by discharging ink as a liquid. The printer 10 includes a controller 100, a user interface 180, a communication interface 190, and a head unit 200.

The user interface 180 of the printer 10 includes a display and control buttons, and exchanges information with the user of the printer 10. The communication interface 190 exchanges information with a personal computer, a digital still camera, a memory card, or another such external device that can be electrically connected to the printer 10. The head unit 200 of the printer 10 includes an ink discharge mechanism that discharges ink. This ink discharge mechanism will be discussed in detail below.

The controller 100 of the printer 10 controls the various components of the printer 10. For instance, the controller 100 performs control such that ink droplets are discharged from the head unit 200 while the head unit 200 and the printing medium 90 are moved relatively, on the basis of data inputted through the communication interface 190. This results in printing on the printing medium 90.

In this working example, the controller 100 is a device including a CPU (central processing unit), a ROM (read only memory), a RAM (random access memory), an input/output interface, and the like, and various functions of the controller 100 are carried out by operation of the CPU on the basis of a computer program. At least some of the functions of the controller 100 can be carried out by an electrical circuit of the controller 100 operating on the basis of the circuit configuration thereof.

In this example, the head unit 200 has a carriage 210, an ink cartridge 220, and a head 280. The carriage 210 of the head unit 200 is connected to the controller 100 via a flexible cable 170, and is configured so as to be movable in a state in which the ink cartridge 220 and head 280 have been installed. The ink cartridge 220 of the head unit 200 contains ink inside, and supplies this ink to the head 280. In this example, a plurality of ink cartridges 220 for the various ink colors (black, cyan, magenta, and yellow; four altogether) are installed in the carriage 210. The head 280 of the head unit 200 is in a position opposite the printing medium 90, and ink supplied from the ink cartridge 220 to the head 280 is discharged in the form of droplets from the head 280 toward the printing medium 90.

In this example, the printer 10 has a primary scanning mechanism and a secondary scanning mechanism for moving the head unit 200 and the printing medium 90 relative to each other. The primary scanning mechanism of the printer 10 has a carriage motor 312 and a drive belt 314, and reciprocally moves the head unit 200 in the primary scanning direction by transmitting the motive force of the carriage motor 312 to the head unit 200 via the drive belt 314. The secondary scanning mechanism of the printer 10 has a conveyor motor 322 and a platen 324, and conveys the printing medium 90 in the secondary scanning direction that intersects the primary scanning direction by transmitting the motive force of the conveyor motor 322 to the platen 324. The carriage motor 312 of the primary scanning mechanism and the conveyor motor 322 of the secondary scanning mechanism operate on the basis of control signals from the controller 100.

In the description of this example, the coordinate axis along the primary scanning direction in which the head unit 200 reciprocally moves is set to the X axis, the coordinate axis along the secondary scanning direction in which the printing medium 90 is conveyed is set to the Y axis, and the coordinate axis facing upward in the gravitational direction is set to the Z axis. The X axis, Y axis, and Z axis are mutually perpendicular coordinate axes.

Figure 2:
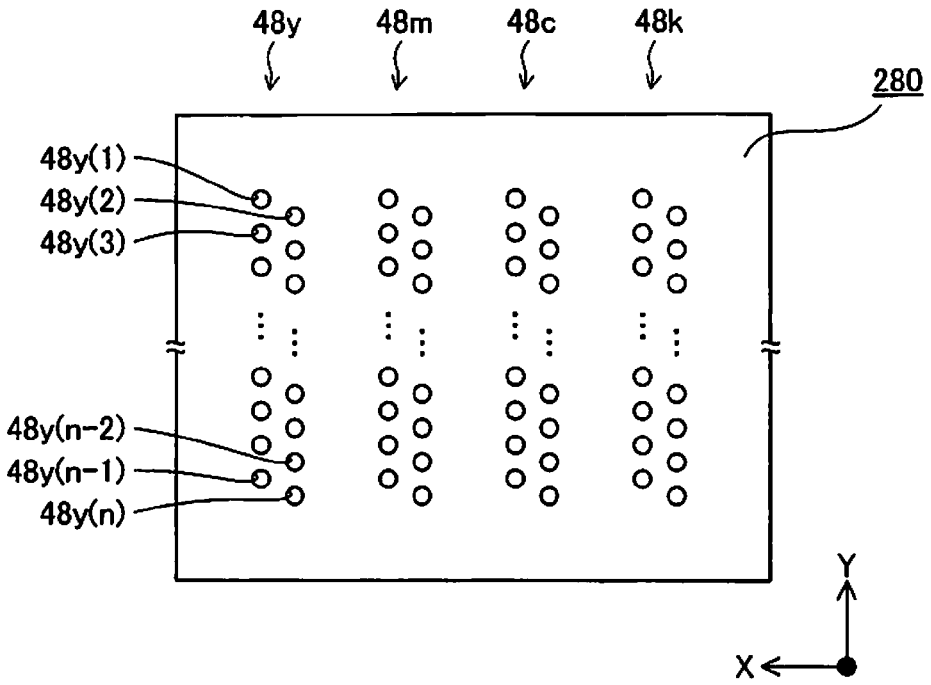
FIG. 2 is a diagram illustrating the structure of a head in a head unit.

FIG. 2 is a diagram illustrating the structure of the head 280 in the head unit 200. FIG. 2 shows the head 280 as seen from the printing medium 90 side. The head 280 of the head unit 200 includes a plurality of nozzles 48 for discharging ink. In this example, n number of (360, for example) nozzles 48 are provided for each ink color (black, cyan, magenta, and yellow; four altogether), with the nozzles 48 for each color being disposed in the order of black, cyan, magenta, and yellow in the primary scanning direction (X axis direction). The n number of nozzles 48 for each color are arranged so as to be offset from each other in the secondary scanning direction (Y axis direction), and in this example are disposed in two alternating rows in the secondary scanning direction (Y axis) in order to reduce the gap between nozzles 48 in the secondary scanning direction (Y axis direction).

In the description of this example, "48" will be used to refer collectively to the nozzles of the head unit 200, "48*k*" refer to black nozzles, "48*c*" to refer to cyan nozzles, "48*m*" to refer to magenta nozzles, and "48*y*" to refer to yellow nozzles. Labels with added nozzle numbers will be used when specifying individual nozzles. For example, as shown in FIG. 2, the first yellow nozzle is labeled 48*y*(1), the second yellow nozzle is labeled 48*y*(2), the third yellow nozzle is labeled 48*y*(3), the (n−1)-th yellow nozzle is labeled 48*y*(n−1), and the n-th yellow nozzle is labeled 48*y*(*n*).

Figure 3:
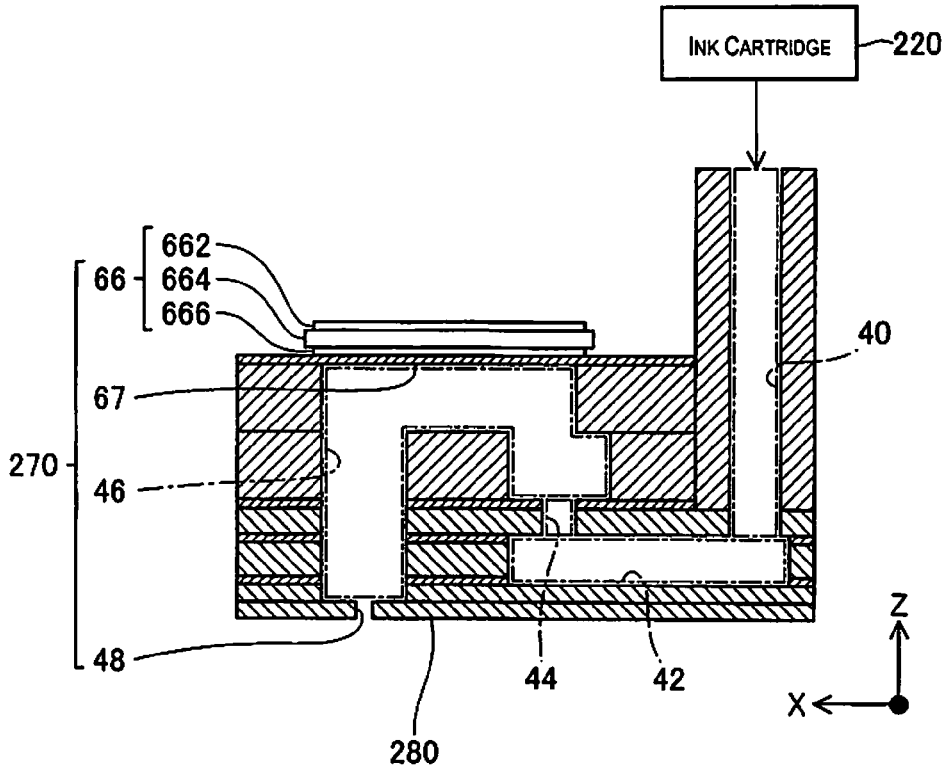
FIG. 3 is a diagram illustrating an ink discharge mechanism in a head unit.

FIG. 3 is a diagram illustrating an ink discharge mechanism in the head unit 200. FIG. 3 shows a cross section of the head 280 cut along the gravitational direction (the Z axis direction). The ink discharge mechanism of the head unit 200 includes a reservoir 42, a supply port 44, a cavity 46, a nozzle 48, a drive element 66, and a diaphragm 67.

The ink discharge mechanism is provided with an intake channel 40 and the reservoir 42 for each color, and these form part of a channel through which the ink flows from the ink cartridge 220 to the nozzle 48. The ink supplied from the ink cartridge 220 to the head unit 200 passes through the intake channel 40 and pools in the reservoir 42.

The supply port 44, the cavity 46, the drive element 66, and the diaphragm 67 of the ink discharge mechanism are provided corresponding to each of the plurality of nozzles 48 formed in the head 280, and make up a discharge component 270 along with the nozzle 48. That is, the head unit 200 includes a plurality of discharge components 270 corresponding to the number of nozzles 48. The discharge component 270 drives the drive element 66 to discharge the ink inside the cavity 46 out of the nozzle 48 communicating with the cavity 46.

The supply port 44 and the cavity 46 of the discharge component 270 form part of the channel through which ink flows from the ink cartridge 220 to the nozzle 48. The supply port 44 is a channel communicating between the reservoir 42 and the cavity 46, and ink is supplied from the reservoir 42 to the cavity 46 through the supply port 44. The cavity 46 is a channel communicating with the nozzle 48, has a channel cross section that is sufficiently larger than that of the supply port 44 and nozzle 48, and holds ink yet to be discharged.

The drive element 66 of the discharge component 270 is provided to the cavity 46 with the diaphragm 67 in between, and the diaphragm 67 of the discharge component 270 forms part of the channel wall in the cavity 46. In this example, the drive element 66 is a unimorph piezoelectric actuator equipped with a piezoelectric body 664 sandwiched between two electrodes 662 and 666, and with the diaphragm 67 provided on the electrode 666 side, but in another example, a laminated piezoelectric actuator can be used as the drive element 66. The drive element 66 bends in the gravitational direction (Z axis direction) under the application of a drive signal, displacing the diaphragm 67. Consequently, it is possible to increase the volume of the cavity 46 to draw in ink from the reservoir 42, and then reduce the volume of the cavity 46 to discharge ink from the nozzle 48.

To return to FIG. 1, the printer 10 in this example has a head wiper 330 and a head cap 340 as a maintenance mechanism (maintenance component) for maintaining the head 280 of the head unit 200. The head wiper 330 of the printer 10 removes any ink adhering to the head 280 by wiping off the head 280.

The head cap 340 of the printer 10 is attached to the head 280 when the head unit 200 is on standby, preventing the ink in the discharge component 270 from drying out by sealing the nozzle 48. If the nozzle 48 of the discharge component 270 becomes clogged, the head cap 340 is used for restoration treatment (maintenance treatment), such as a flushing or suction treatment. When performing flushing, the head cap 340 is placed across from the head 280 and catches ink droplets discharged from the nozzle 48 of the discharge component 270, and when performing suction, deteriorated ink is drawn out of the nozzle 48 with the head cap 340 attached to the head 280. Performing restoration with the head cap 340 restores a discharge component 270 that has become clogged with ink degraded by air bubbles or thickening, to a state in which the ink can be discharged properly again.

Figure 4:
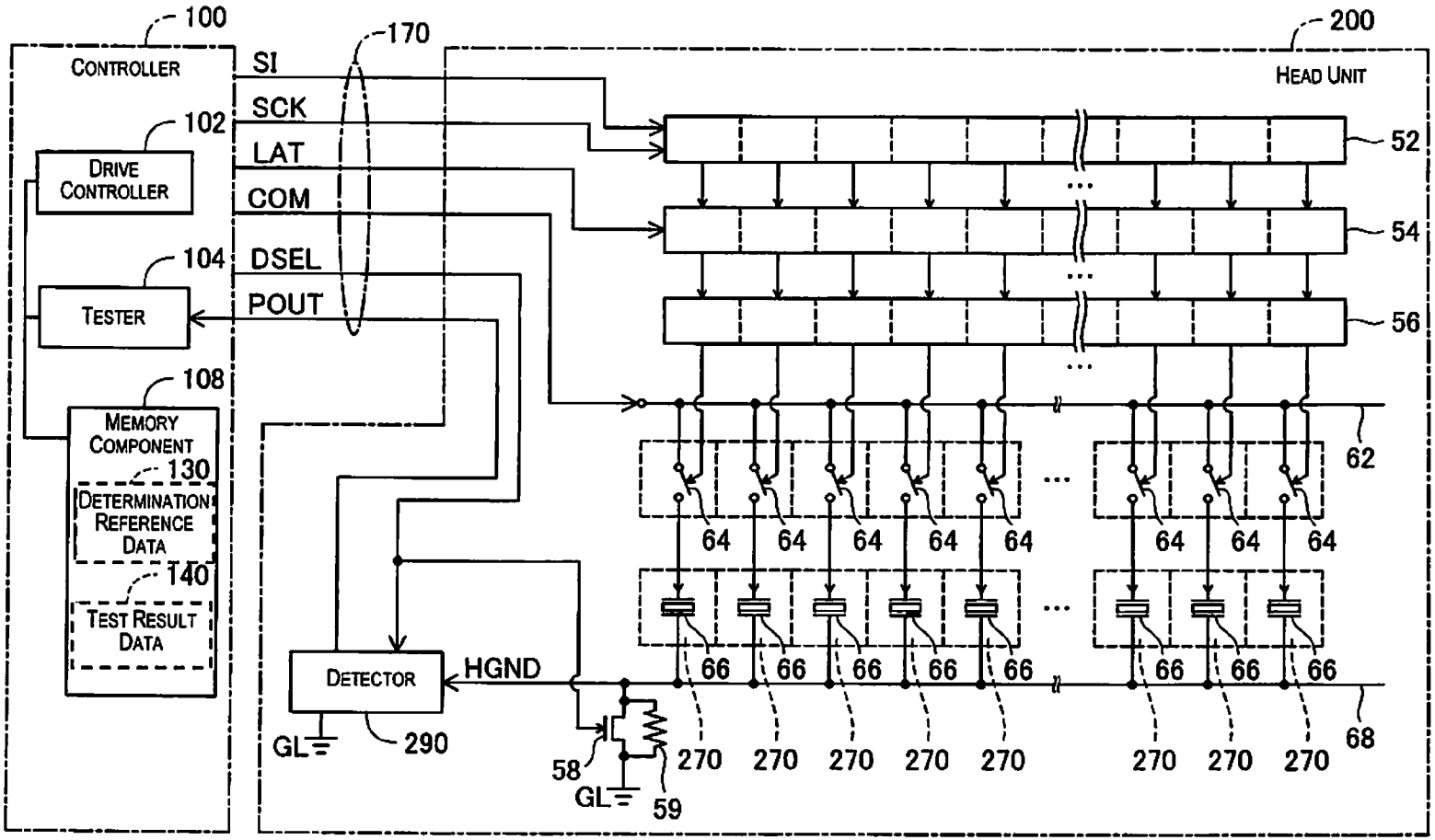
FIG. 4 is a diagram illustrating the electrical configuration of a head unit and a controller.

FIG. 4 is a diagram illustrating the electrical configuration of the controller 100 and the head unit 200. The controller 100 includes a drive controller 102, a tester 104, and a memory component 108. The head unit 200 includes a shift resistor 52, a latching circuit 54, a level shifter 56, a switch 58, shared electrical paths 62 and 68, a plurality of switches 64, a detector 290.

The drive controller 102 of the controller 100 controls the drive of the plurality of drive elements 66 of the head unit 200 through the shared electrical path 62 of the head unit 200. In this example, the drive controller 102 applies a drive signal COM that drives the drive element 66 to the shared circuit 62, and, while applying the drive signal COM, outputs a shift input signal SI, a clock signal SCK, and a latching signal LAT to the head unit 200.

The shift resistor 52 of the head unit 200 is a memory device for storing instruction data directing the operation of the drive elements 66 in the plurality of discharge components 270. Instruction data corresponding to the various drive elements 66 is outputted sequentially and synchronously with the clock signal SCK to the shift input signal SI from the controller 100, and instruction data corresponding to the various drive elements 66 is stored sequentially in the shift resistor 52 on the basis of the shift input signal SI and the clock signal SCK. In this example, the instruction data corresponding to the various drive elements 66 is 2-bit data indicating either [0,0], [0,1], [1,0], or [1,1].

The latching circuit 54 of the head unit 200 holds the instruction data for the various drive elements 66 stored in the shift resistor 52 on the basis of the latching signal LAT from the controller 100, and outputs a logic signal corresponding to the various sets of instruction data to the level shifter 56. The latching signal LAT is outputted from the controller 100 when all of the instruction data for the various drive elements 66 has been stored in the shift resistor 52. In this example, the latching circuit 54 outputs a low level logic signal for instruction data of [0,0], a low level logic signal followed by a high level one for instruction data of [0,1], a high level logic signal followed by a low level one for instruction data of [1,0], and a high level logic signal for instruction data of [1,1].

The level shifter 56 of the head unit 200 outputs to each of the plurality of switches 64 a voltage at a level capable of switching the various switches 64 connected to the various drive elements 66 on or off according to the logic signal outputted from the latching circuit 54. In this example, the level shifter 56 outputs voltage at a level that will switch off the switch 64 in response to a low level logic signal from the latching circuit 54, and voltage at a level that will switch on the switch 64 in response to a high level logic signal from the latching circuit 54.

The plurality of switches 64 in the head unit 200 switch on and off the electrical connection between the shared electrical path 62 and the various drive elements 66. A drive signal COM for driving the drive elements 66 is inputted from the controller 100 to the shared electrical path 62 of the head unit 200. In the ON state, in which the drive element 66 is electrically connected by the switch 64 to the shared electrical path 62, the drive signal COM is applied to the electrode 662 side of the drive element 66, and in the OFF state, in which the drive element 66 is electrically disconnected from the shared electrical path 62 by the switch 64, the drive signal COM is not applied to the drive element 66. In this example, the switches 64 are analog switches featuring transmission gates.

A switch 58 of the head unit 200 electrically connects (grounds) a shared electrical path 68, which is electrically connected to the electrode 666 side of each drive element 66, to a ground line GL. The ground line GL is an electrical conductor that is connected to a reference potential point in the printer 10, and in this example it is connected to the housing (not shown) of the printer 10.

In this example, a resistor 59 is electrically connected in series with the switch 58, and while the switch 58 is electrically disconnecting the shared electrical path 68 from the ground line GL on the basis of a detection execution signal DSEL outputted from the controller 100, the detector 290 detects an electrical signal HGND outputted from the shared electrical path 68 by using an op-amp to amplify a voltage change based on the current flowing to the resistor 59. Consequently, the detector 290 can effectively detect the electromotive force applied from each of the drive element 66 to the shared electrical path 68 on the basis of the change in voltage between the ground line GL and the electrical signal HGND of the shared electrical path 68.

The detector 290 of the head unit 200 detects vibration produced by the drive of the drive elements 66. In this example, the detector 290 detects residual vibration, which is vibration that is caused by the drive of the drive elements 66 and remains after the drive of the drive elements 66. In this example, the drive elements 66 function as sensors that detect residual vibration and output an electrical signal SW corresponding to the residual vibration, and the electrical signal SW outputted from a drive element 66 by the electromotive force accompanying residual vibration is applied to the shared electrical path 68. The detector 290 detects the electrical signal SW as residual vibration by measuring the electrical signal HGND of the shared electrical path 68. In this example, the detector 290 detects the electrical signal SW according to the detection execution signal DSEL outputted from the controller 100, and outputs to the controller 100 a detection signal POUT indicating a detected value of the residual vibration as this detection result.

Figure 5:
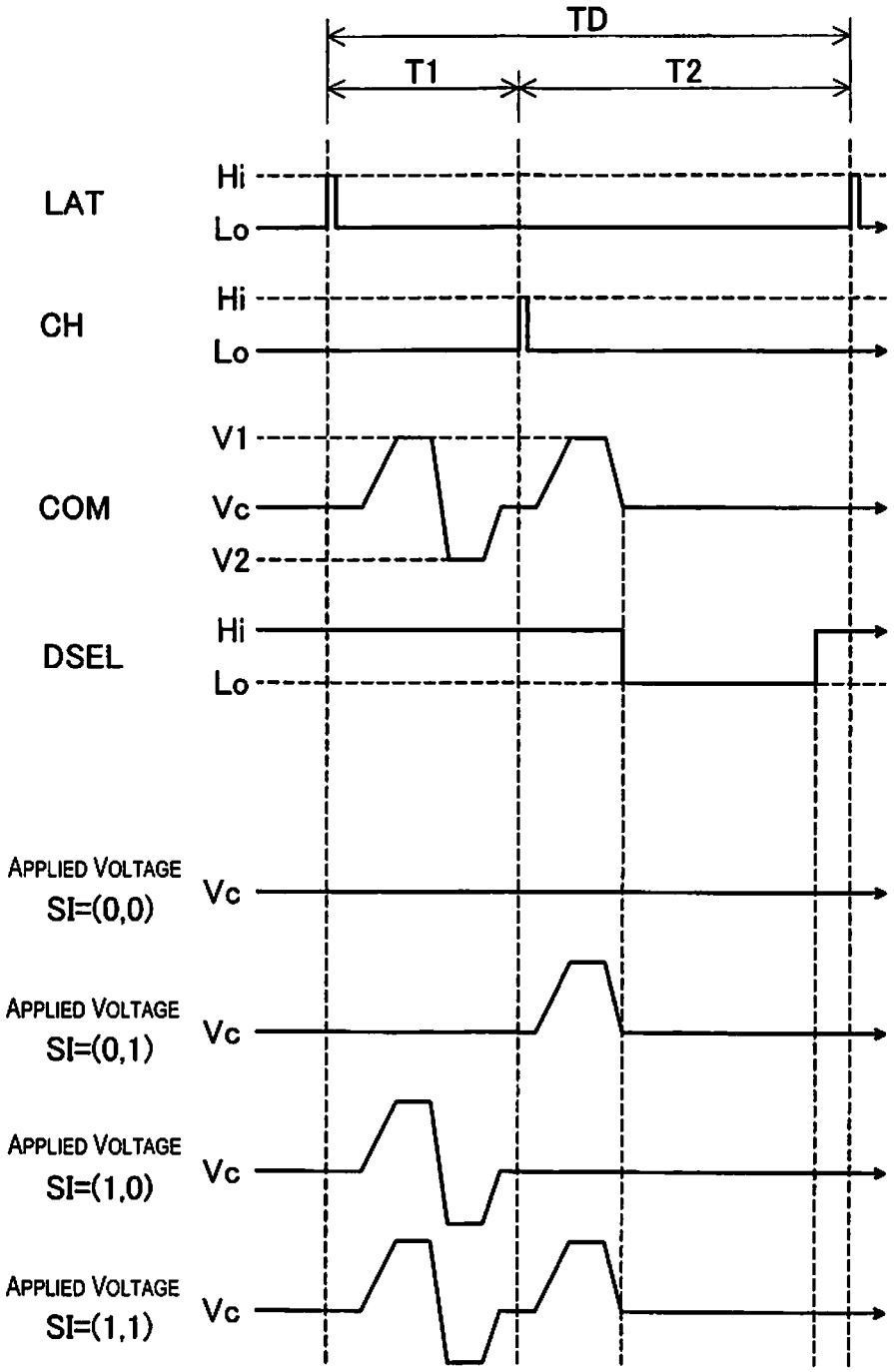
FIG. 5 is a diagram illustrating an example of various signals in a head unit and a controller.

FIG. 5 is a diagram illustrating an example of various signals in the head unit 200 and the controller 100. FIG. 5 shows the time changes in the latching signal LAT, the switching signal CH, the drive signal COM, and the detection execution signal DSEL in that order starting from the top, and in the lower part shows the time changes in the voltage applied to the drive elements 66 according to instruction data of the shift input signal SI.

The latching signal LAT is a logic signal that rises according to a drive period TD, and is inputted from the controller 100 to the latching circuit 54. The drive period TD corresponds to the time when one pixel is produced on the printing medium 90 by driving the drive element 66 in each of the discharge components 270.

The switching signal CH is a signal produced in the head unit 200 on the basis of the latching signal LAT, and is a logic signal that rises according to the passage of a predetermined time period since the rise of the latching signal LAT. The latching circuit 54 outputs a logic signal corresponding to the first bit of the 2-bit instruction data received from the shift resistor 52 during a first time period T1 from the rise of the latching signal LAT until the rise of the switching signal CH, and outputs a logic signal corresponding to the second bit of the instruction data during a second time period T2 from the rise of the switching signal CH until the rise of the latching signal LAT.

The drive signal COM is a voltage signal outputted periodically and synchronously with the drive cycle TD, and is supplied from the controller 100 to the drive element 66 via the shared electrical path 62 and the switch 64. During the first time period T1, the drive signal COM rises from a state in which an intermediate voltage Vc is maintained to a voltage V1 that is higher than the intermediate voltage Vc, then falls off to a voltage V2 that is lower than the intermediate voltage Vc, and again becomes the intermediate voltage Vc. During the subsequent second time period T2, the drive signal COM rises from the intermediate voltage Vc to a voltage V1 that is higher than the intermediate voltage Vc, and then enters a state in which the intermediate voltage Vc is maintained. The drive signal COM in the first time period T1 is an application level signal for discharging an ink droplet from the nozzle 48 of the discharge component 270. The drive signal COM in the second time period T2 is an application level signal for generating residual vibration without discharging an ink droplet from the nozzle 48.

The detection execution signal DSEL is a logic signal that falls off from the point when the drive signal COM has returned from the voltage V1 to the intermediate voltage Vc in the second time period T2 until a point prior to the end of the second time period T2 when the discharge component 270 is tested on the basis of residual vibration. If the detection execution signal DSEL falls off, the switch 58 of the head unit 200 electrically disconnects the shared electrical path 68 from the ground, and the detector 290 of the head unit 200 detects the electrical signal HGND of the shared electrical path 68.

When the instruction data of the shift input signal SI is [0,0], the voltage applied to the drive element 66 is held at the intermediate voltage Vc throughout the drive time period TD. Consequently, no ink droplet is discharged from the discharge component 270 corresponding to that drive element 66, and no residual vibration is generated. Instruction data of [0,0] of the shift input signal SI is set to a discharge component 270 that forms no pixel during printing, or to a discharge component 270 that is not to be tested on the basis of residual vibration.

When the instruction data of the shift input signal SI is [0,1], the voltage applied to the drive element 66 is held at the intermediate voltage Vc throughout the first time period T1, then rises to the voltage V1 in the second time period T2. Consequently, residual vibration can be generated without discharging an ink droplet at the discharge component 270 corresponding to that drive element 66. Instruction data of [0,1] of the shift input signal SI is set to a discharge component 270 that is to be tested on the basis of residual vibration in the course of carrying out testing without forming a pixel.

When the instruction data of the shift input signal SI is [1,0], the voltage applied to the drive element 66 changes to the voltage V1 and the voltage V2 in the first time period T1, then is held at the intermediate voltage Vc in the second time period T2. Consequently, an ink droplet is discharged from the discharge component 270 corresponding to that drive element 66. Instruction data of [1,0] of the shift input signal SI is set to a discharge component 270 that forms a pixel during printing.

When the instruction data of the shift input signal SI is [1,1], the voltage applied to the drive element 66 changes to the voltage V1 and the voltage V2 in the first time period T1, then changes to the voltage V1 in the second time period T2. Consequently, residual vibration suited to the testing of a discharge component 270 can be generated while an ink droplet is discharged at the discharge component 270 corresponding to that drive element 66. Instruction data of [1,1] of the shift input signal SI is set to a discharge component 270 that is to be tested on the basis of residual vibration in the course of carrying out a test while forming a pixel.

To return to FIG. 4, the tester 104 of the controller 100 receives the detection signal POUT from the detector 290 of the head unit 200 and tests the discharge component 270 on the basis of the residual vibration indicated by this detection signal POUT. In this example, the tester 104 tests the discharge component 270 on the basis of the length of the period of the residual vibration and the change in the period of the residual vibration.

In this example, the tester 104 identifies the state of the discharge component 270 to be either a normal state, an abnormal discharge state, a non-discharge state caused by the admixture of air bubbles, or a non-discharge state caused by increased viscosity. A normal state is one in which ink can be discharged at the prescribed adhesion location and in the prescribed adhesion shape. An abnormal discharge state is one in which ink can be discharged, but the ink droplet adhesion location and the adhesion shape have exceeded the permissible range for a normal state. A non-discharge state caused by the admixture of air bubbles is one in which ink cannot be discharged because air bubbles have become admixed in the ink inside the cavity 46. A non-discharge state caused by increased viscosity is one in which ink cannot be discharged because the ink has thickened inside the cavity 46.

The memory component 108 of the controller 100 stores determination reference data 130 and test result data 140. The determination reference data 130 in the memory component 108 is data indicating a determination reference for determining the state of the discharge component 270 on the basis of the electrical signal SW, and in this example it is stored in the memory component 108 when the printer 10 is shipped from the factory. The test result data 140 in the memory component 108 is data indicating the result of testing the discharge component 270 by the tester 104, and is stored in the memory component 108 according to whether or not testing has been performed by the tester 104.

Figure 6:
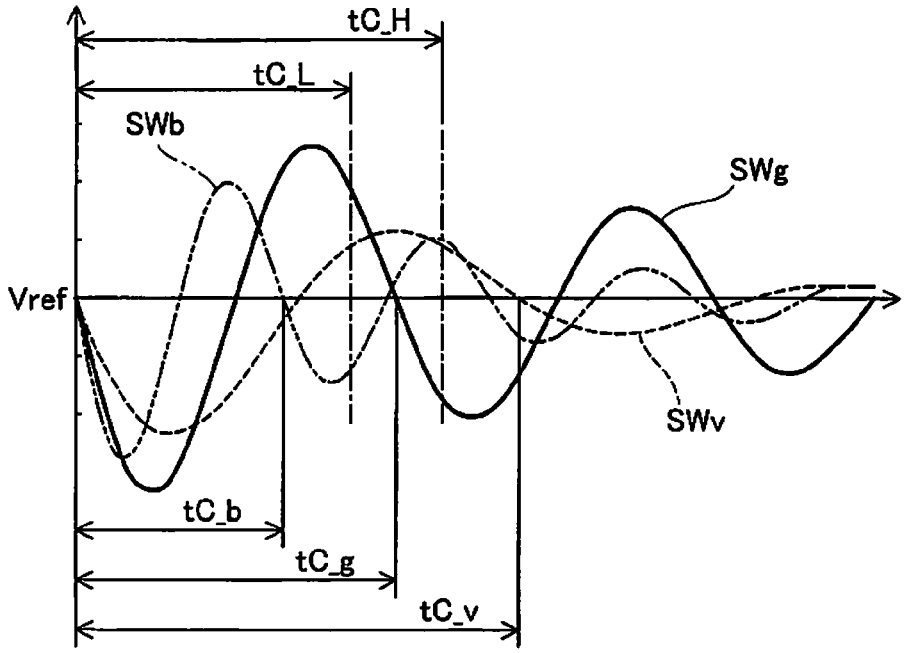
FIG. 6 is a diagram illustrating an example of the change in an electrical signal corresponding to residual vibration.

FIG. 6 is a diagram illustrating an example of the electrical signal SW corresponding to residual vibration. In FIG. 6, the vertical axis is voltage and the horizontal axis is time, and the change over time in electrical signals SWg, SWb, and SWv with respect to a reference voltage Vref is shown.

The electrical signal SWg in FIG. 6 shows the electrical signal SW corresponding to residual vibration in a discharge component 270 in a normal state in which ink can be discharged. The electrical signal SWb in FIG. 6 shows the electrical signal SW corresponding to residual vibration in a discharge component 270 in a non-discharge state caused by the admixture of air bubbles. The electrical signal SWv in FIG. 6 shows the electrical signal SW corresponding to residual vibration in a discharge component 270 in a non-discharge state caused by increased viscosity.

When a step response when a pressure P is applied to a simple harmonic oscillation calculation model assuming the diaphragm 67 in the discharge component 270 is calculated for a volume velocity u, the following Formulas 1a, 1b, and 1c are obtained.

[First Mathematical Formula]

$$u = \frac{P}{\omega \cdot m} e^{-\omega t} \cdot \sin\omega t \ (\mathrm{m^3/s}) \tag{1a}$$

$$\omega = \sqrt{\frac{1}{m \cdot c} - \alpha^2} \tag{1b}$$

$$\alpha = \frac{r}{2m} \tag{1c}$$

In the First Mathematical Formula above, the channel resistance r depends on the channel shape of the supply port 44, the cavity 46, the nozzle 48, and so forth, and on the viscosity of the ink within these channels; the inertance m depends on the mass of the ink within channels such as the supply port 44, the cavity 46, and the nozzle 48, and the compliance c depends on the stretchability of the diaphragm 67.

In a non-discharge state caused by the admixture of air bubbles, there is less ink in the cavity 46, so the inertance m is mainly reduced. When the inertance m decreases, the angular velocity ω increases as shown in Formula 1b above. Accordingly, as shown in FIG. 6, the period tC_b of the electrical signal SWb in a non-discharge state caused by the admixture of air bubbles is shorter than the period tC_g of the electrical signal SWg in a normal state.

In a non-discharge state caused by increased viscosity, the ink thickens in the cavity 46, so the channel resistance r increases. When the channel resistance r increases, as is clear from Formulas 1b and 1c, the angular velocity ω is smaller. Accordingly, as shown in FIG. 6, the period tC_v of the electrical signal SWv in a non-discharge state caused by increased viscosity is longer than the period tC_g of the electrical signal SWg in a normal state, and the amount of attenuation of the electrical signal SWv is greater than that of the electrical signal SWg.

In this example, if the period tC of the electrical signal SW is within a range of from a lower threshold tC_L to an upper threshold tC_H (tC_L≤tC≤tC_H), the state of the discharge component 270 is concluded to be a normal state. In this example, if the period tC of the electrical signal SW is shorter than the lower threshold tC_L (tC<tC_L), the state of the discharge component 270 is concluded to be a non-discharge state caused by the admixture of air bubbles, and if the period tC of the electrical signal SW is longer than the upper threshold tC_H (tC_H<tC), the state of the discharge component 270 is concluded to be a non-discharge state caused by increased viscosity.

FIG. 6 shows the periods tC_g, tC_b, and tC_v as the first periods of the electrical signals SWg, SWb, and SWv, but the periods of the electrical signals SWg, SWb, and SWv are logically constant, and the values for the periods tC_g, tC_b, and tC_v will be the same for periods after the first period (the second period, third period, . . . ).

Figure 7:
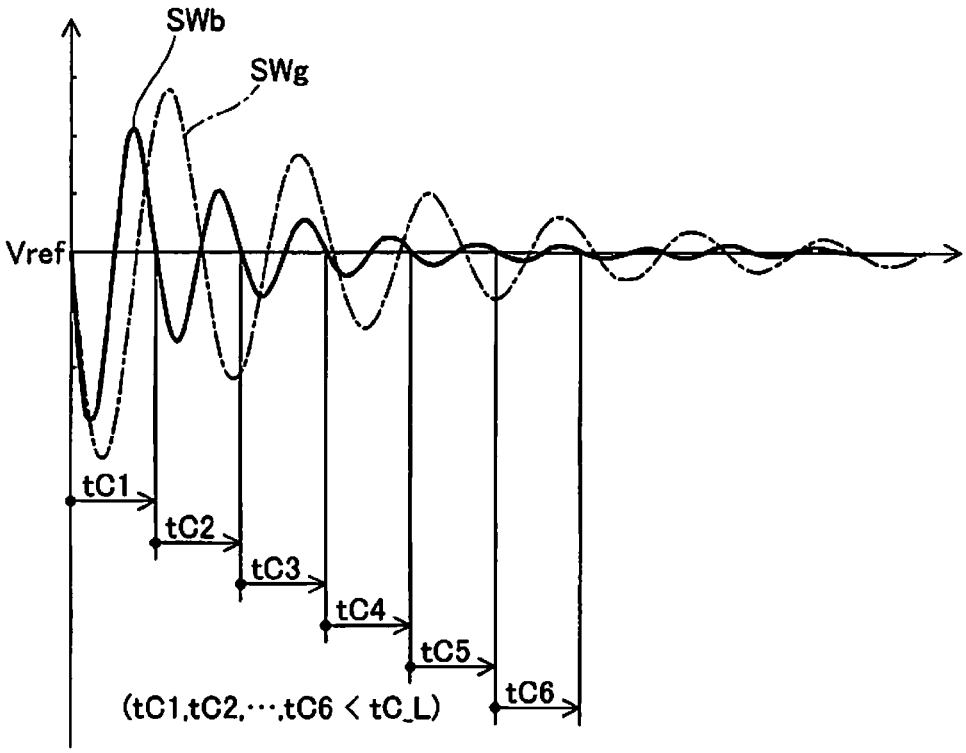
FIG. 7 is a diagram illustrating an example of an electrical signal in a non-discharge state produced by the admixture of air bubbles.

FIG. 7 is a diagram illustrating an example of the electrical signal SWb in a non-discharge state caused by the admixture of air bubbles. In FIG. 7, the vertical axis is voltage and the horizontal axis is time, and a first period tC1 to a sixth period tC6 are shown as the change over time in the electrical signal SWb with respect to the reference voltage Vref, while contrasting with the electrical signal SWg in a normal state. As shown in FIG. 7, the values for the second period tC2 to the sixth period tC6 beyond the first period tC1 in the electrical signal SWb are equivalent to the value for the first period tC1, and the values for the first period tC1 to the sixth period tC6 of the electrical signal SWb are shorter than those for the lower threshold tC_L in a normal state (tC1, tC2, . . . , tC6<tC_L).

Figure 8:
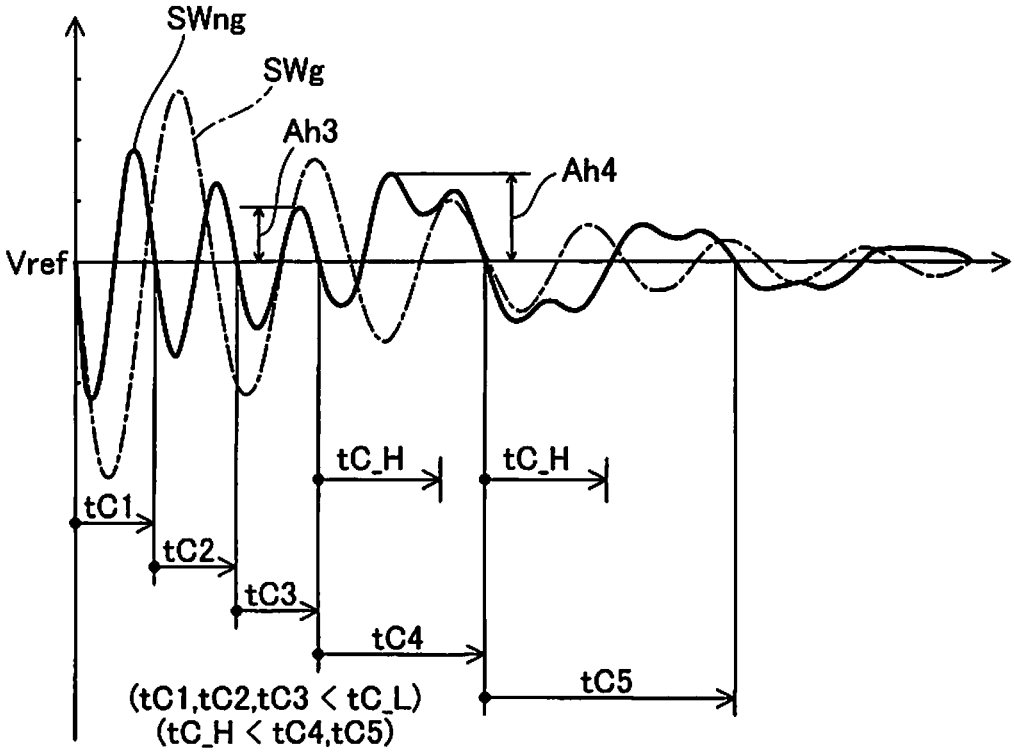
FIG. 8 is a diagram illustrating an example of test processing executed by the controller of a printer.

FIG. 8 is a diagram illustrating an example of an electrical signal SWng in an abnormal discharge state. In FIG. 8, the vertical axis is voltage and the horizontal axis is time, and the first period tC1 to the fifth period tC5 are shown as the change over time in the electrical signal SWng with respect to the reference voltage Vref. The electrical signal SWng in FIG. 8 shows the electrical signal SW corresponding to residual vibration in the discharge component 270 in an abnormal discharge state, and this abnormal discharge state is one in which ink can be discharged, but the ink droplet adhesion location and the adhesion shape have exceeded the permissible range for a normal state due to the admixture of air bubbles into the ink in the cavity 46.

The electrical signal SWng in an abnormal discharge state caused by the admixture of air bubbles differs from the electrical signal SWg in a normal state, the electrical signal SWb in a non-discharge state caused by the admixture of air bubbles, and the electrical signal SWv in a non-discharge state caused by increased viscosity in that its period changes. In the example in FIG. 8, the values for the first period tC1, the second period tC2, and the third period tC3 in the electrical signal SWng are shorter than the lower threshold tC_L in a normal state (tC1, tC2, tC3<tC_L), but the subsequent fourth period tC4 and fifth period tC5 are longer than the upper threshold tC_H in a normal state (tC_H<tC4, tC5).

In the example in FIG. 8, if we compare the amplitudes of the third period tC3 and the fourth period tC4 in which the period of the electrical signal SWng changes, we see that the maximum amplitude Ah4 of the fourth period tC4 increases more than the maximum amplitude Ah3 of the third period tC3. In the example in FIG. 8, the electrical signal SWng has one minimum point and one maximum point in each of the first to third periods tC1 to tC3, but has two minimum points and two maximum points in the fourth period tC4, and has three minimum points and three maximum points in the fifth period tC5.

Figure 9:
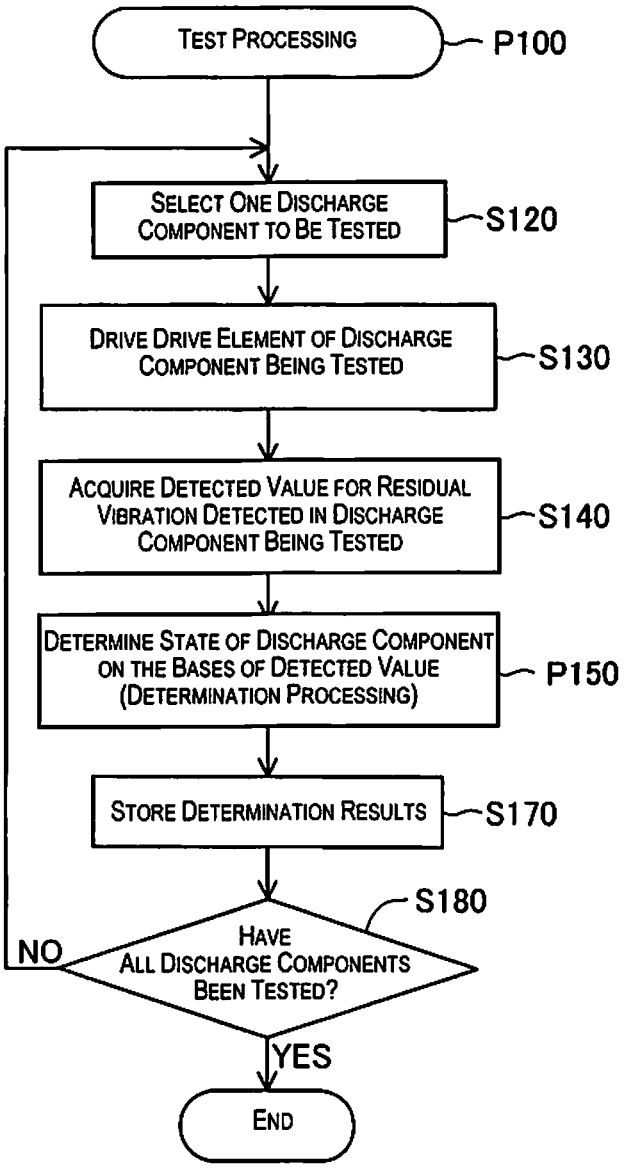
FIG. 9 is a flowchart showing details of the test processing executed by the controller of a printer.

A2. Operation of Printer:

FIG. 9 is a flowchart showing details of the test processing P100 executed by the controller 100 of the printer 10. The test processing P100 involves testing the discharge components 270 in the head unit 200 based on residual vibration. In this example, the test processing P100 is accomplished by having the CPU of the controller 100 operate as the tester 104 on the basis of a computer program. In this example, the controller 100 starts the test processing P100 on the basis of an instruction input from the user or a preset date and time.

When the test processing P100 is started, the controller 100 selects one of the plurality of discharge components 270 in the head unit 200 as the one to be tested (step S120). After the discharge component 270 to be tested has been selected (step S120), the controller 100 operates as the drive controller 102 and thereby drives the drive element 66 of the discharge component 270 being tested (step S130).

More specifically, [0,1] is set for the instruction data of the shift input signal SI corresponding to the discharge component 270 to be tested, [0,0] is set for the instruction data of the shift input signal SI corresponding to the other discharge components 270, and the latching signal LAT, the drive signal COM, and the detection execution signal DSEL are outputted to the head unit 200 as shown in FIG. 5 along with the shift input signal SI and the clock signal SCK. Consequently, the electrical signal SW corresponding to residual vibration from the drive element 66 in the discharge component 270 being tested is applied to the shared electrical path 68. Here, the electrical signal HGND of the shared electrical path 68 detected by the detector 290 of the head unit 200 becomes the electrical signal SW corresponding to residual vibration in the discharge component 270 being tested, and the detector 290 outputs to the controller 100 the detection signal POUT indicating the detected value for the electrical signal SW as this detection result.

After the drive element 66 being tested has been driven (step S130), the controller 100 acquires the detected value for the electrical signal SW through the detection signal POUT outputted from the detector 290 of the head unit 200 (step S140). In this example, the controller 100 acquires the period tC of the electrical signal SW detected during the rise period of the detection execution signal DSEL as the detected value for the electrical signal SW corresponding to residual vibration.

After the detected value for residual vibration has been acquired (step S140), the controller 100 executes determination processing P150. In this determination processing P150, the controller 100 determines the state of the discharge component 270 being tested, on the basis of the residual vibration detected as the electrical signal SW by the detector 290 in the head unit 200.

Figure 10:
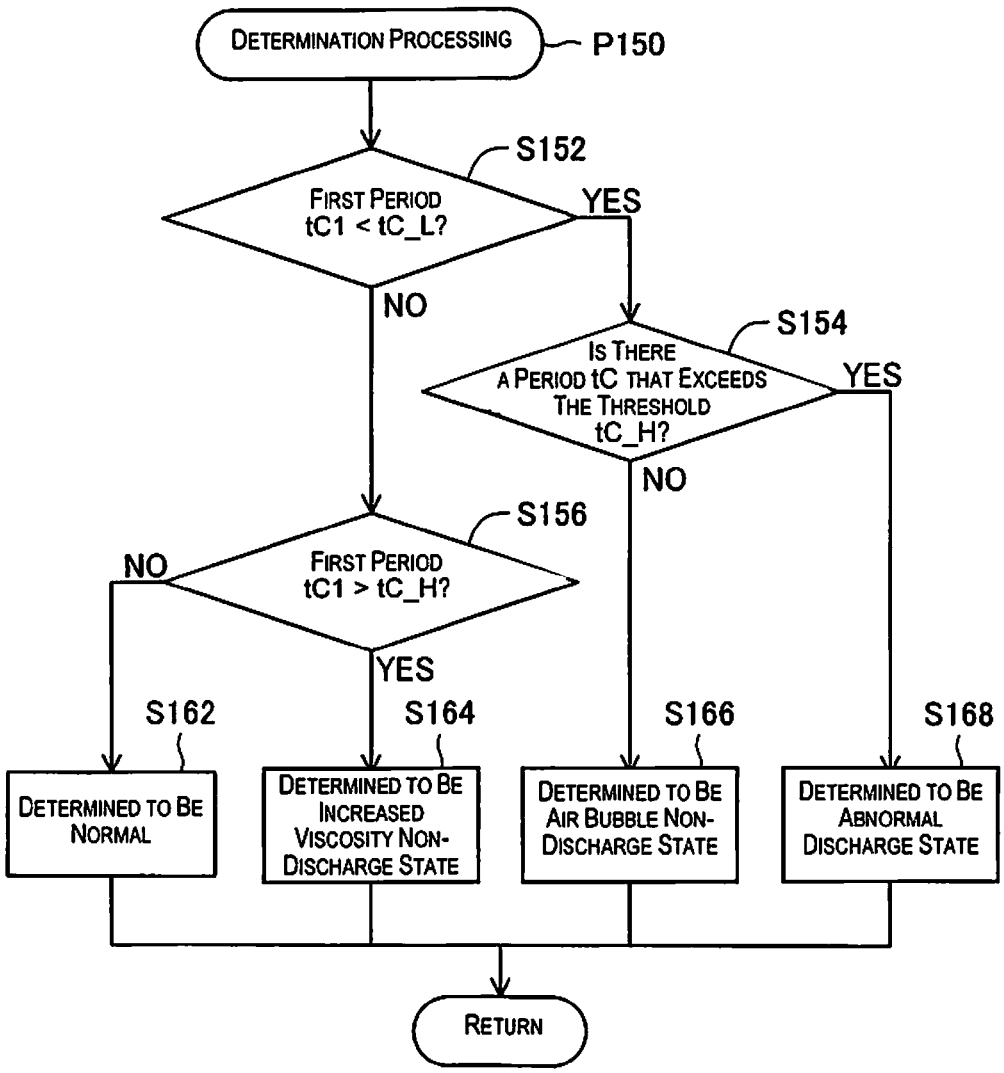
FIG. 10 is a flowchart showing details of determination processing.

FIG. 10 is a flowchart showing details of the determination processing P150. When the determination processing P150 is started, the controller 100 decides whether or not the first period tC1 of detected residual vibration is less than the lower threshold tC_L in a normal state (step S152).

If the first period tC1 is at least the lower threshold tC_L ("No" in step S152), the controller 100 decides whether or not the first period tC1 of detected residual vibration is greater than the upper threshold tC_H in a normal state (step S156).

If the first period tC1 is no more than the upper threshold tC_H ("No" in step S156), the controller 100 decides whether or not the discharge component 270 being tested is in a normal state (step S162), after which the determination processing P150 is ended. The electrical signal SW when a normal state has thus been determined exhibits the voltage change represented by the electrical signal SWg in FIG. 6.

If the first period tC1 is greater than the upper threshold tC_H ("Yes" in step S156), the controller 100 determines that the discharge component 270 being tested is in a non-discharge state caused by increased viscosity (step S164), after which the determination processing P150 is ended. The electrical signal SW when a non-discharge state caused by increased viscosity has thus been determined exhibits the voltage change represented by the electrical signal SWv in FIG. 6.

If the first period tC1 is less than the lower threshold tC_L ("Yes" in step S152), the controller 100 decides whether or not a period tC that exceeds the upper threshold tC_H has been detected as the period tC of the second period tC2 and thereafter following the first period tC1 (step S154). Specifically, the controller 100 decides whether or not there is a change in the period of residual vibration from a first period that is less than the lower threshold tC_L to a second period that exceeds the upper threshold tC_H. In this example, the controller 100 decides whether or not a period tC that exceeds the upper threshold tC_H has been detected for the period tC of the second period tC2 and thereafter in the time period of a voltage level that can be sufficiently distinguished from noise, out of the period tC of the electrical signal SW detected while the detection execution signal DSEL is at a low level.

If no period tC that exceeds the upper threshold tC_H is detected ("No" in step S154), that is, if there is no change in the period of residual vibration from a first period that is less than the lower threshold tC_L to a second period that exceeds the upper threshold tC_H, the controller 100 determines that the discharge component 270 being tested is in a non-discharge state caused by the admixture of air bubbles (step S166), after which the determination processing P150 is ended. The electrical signal SW when a non-discharge state caused by the admixture of air bubbles is thus determined exhibits the voltage change represented by the electrical signal SWb in FIGS. 6 and 7.

If a period tC that exceeds the upper threshold tC_H is detected ("Yes" in step S154), that is, if there is a change in the period of residual vibration from a first period that is less than the lower threshold tC_L to a second period that exceeds the upper threshold tC_H, the controller 100 determines that the discharge component 270 being tested is in an abnormal discharge state (step S168), after which the determination processing P150 is ended. The electrical signal SW when an abnormal discharge state has thus been determined exhibits the voltage change represented by the electrical signal SWng in FIG. 8.

To return to the description of FIG. 9, after the determination processing P150, the controller 100 stores the determination result of the determination processing P150 (step S170). After this, the controller 100 repeatedly executes the processing up to the selection of the discharge component 270 to be tested (step S120) until all of the discharge components 270 in the head unit 200 have been tested ("No" in step S180). When all of the discharge components 270 in the head unit 200 have been tested ("Yes" in step S180) are tested, the controller 100 ends the test processing P100.

In this example, the controller 100 executes flushing, suction, or other such restoration treatment (maintenance treatment) using the head cap 340, according to the test result of the test processing P100. The restoration treatment can be executed as dictated by the test result of the test processing P100, such as according to whether there is a non-discharge state caused by increased viscosity, a non-discharge state caused by the admixture of air bubbles, or an abnormal discharge state.

Also, restoration treatment can be executed when a non-discharge state caused by increased viscosity or by air bubbles is determined, and a restoration treatment based on user settings or on the default settings of the printer 10 can be executed when an abnormal discharge state is determined. Consequently, restoration treatment is executed in situations in which degradation of print quality attributable to an abnormal discharge state is unacceptable, whereas restoration treatment is not executed in situations in which degradation of print quality attributable to an abnormal discharge state is tolerable, which cuts down on the amount of ink and electrical power used for restoration treatment.

A3: Effect

With the printer 10 of the working example described above, it is possible to determine an abnormal discharge state for a discharge component 270 in which the period tC of residual vibration has changed, as represented by the electrical signal SWng in FIG. 8. Also, since the head cap 340 (a maintenance component) is provided, it is possible to deal with an abnormal discharge state of a discharge component 270 for which the period tC of residual vibration changes.

Also, since the discharge component 270 is tested on the basis of the change in the period tC of residual vibration from a first period in which it is less than the lower threshold tC_L (first threshold) to a second period in which it is greater than the upper threshold tC_H (second threshold) ("Yes" in step S152 and "Yes" in step S154 of the determination processing P150), it is possible to determine an abnormal discharge state for the discharge component 270 attributable to the admixture of air bubbles, as represented by the electrical signal SWng in FIG. 8.

Also, when the first period tC1 (the initial period) corresponds to a set period less than the lower threshold tC_L, the discharge component 270 is tested on the basis of the change in the period tC of residual vibration ("Yes" in step S152, step S154 in the determination processing P150), and when the first period tC1 (the initial period) is different from a set period less than the lower threshold tC_L, the discharge component 270 is tested on the basis of this first period tC1 ("No" in step S152, step S156 in the determination processing P150), so the processing load required by testing of the discharge component 270 on the basis of residual vibration can be reduced.

B. Other Embodiments

An embodiment of the invention was described above, but the invention is not limited in any way to or by this embodiment, and the invention can of course be worked in various modes without departing from the gist of the invention.

For instance, in the above working example, the drive element 66 was used as a sensor for sensing residual vibration in the discharge component 270, but in another embodiment, a dedicated sensor for sensing residual vibration can be used separately from the drive element 66.

Also, in the above embodiment, residual vibration was detected by driving the drive element 66 at an application level that generated residual vibration without discharging an ink droplet, but in another embodiment, residual vibration can be detected by driving the drive element 66 at an application level that discharges an ink droplet.

Also, in the above embodiment, the test processing P100 was carried out at a different timing from that of printing to the printing medium 90, but in another embodiment, the discharge component 270 can be tested on the basis of an electrical signal SW corresponding to residual vibration while the printing medium 90 is being printed.

Also, in the above embodiment, the determination processing P150 was carried out on the basis of the period tC of residual vibration, but in another embodiment, a determination threshold used in determination based on the amplitude or phase of the residual vibration can be included ahead of time in the determination reference data 130, and the test processing P100 carried out on the basis of the phase and/or the amplitude, in addition to the period tC of residual vibration. More specifically, as in the example in FIG. 8, if we compare the amplitudes of the third period tC3 and the fourth period tC4 in which the period of the electrical signal SWng changes, we see that the maximum amplitude Ah4 of the fourth period tC4 increases more than the maximum amplitude Ah3 of the third period tC3, so the discharge component 270 can be tested on the basis of the increase in the amplitude of residual vibration when there is a change in the period tC of residual vibration, in addition to the change in the period tC of residual vibration, as conditions for determining an abnormal discharge state. Consequently, it is possible to reduce error in the determination of an abnormal discharge state attributable to the admixture of air bubbles.

In addition to restoration treatment corresponding to the test result of the test processing P100, or instead of this restoration treatment, the controller 100 can notify the user of the test result of the test processing P100 through the user interface 180, or can notify an external device through the communication interface 190. Also, if a non-discharge state caused by increased viscosity or by the admixture of air bubbles is determined, notification processing can be executed to notify of the test result of the test processing P100, and if an abnormal discharge state is determined, it can be decided whether or not to execute notification processing on the basis of user settings or the default settings of the printer 10. This allows notification processing to be executed in situations in which degradation of print quality attributable to an abnormal discharge state is unacceptable, whereas restoration treatment will not be executed in situations in which degradation of print quality attributable to an abnormal discharge state is tolerable, which cuts down on the amount of ink and electrical power used for notification processing.

Also, in the above working example, the signal level of the drive signal driving the drive element in each of the discharge components 270 was a single voltage V1, but in another embodiment, a determination reference corresponding to the signal levels of drive signals by rank (such as voltage, current, amount of power, etc.) can be included ahead of time in the determination reference data 130, and the test processing P100 carried out according to the signal levels of the drive signals. This better prevents mistaken determination of testing based on residual vibration by taking into account the characteristics of residual vibration that vary with the drive signal level.

The vibration detected by the detector 290 can be any vibration that is attributable to the drive of the drive element 66. For example, vibration of the ink in the cavity 46 caused by drive of the drive element 66 can be detected, or vibration of the drive element 66 after the drive of the drive element 66 can be detected, or vibration of the diaphragm 67 caused by drive of the drive element 66 can be detected. Also, the drive element 66 can serve a dual purpose as a means for sensing vibration attributable to the drive of the drive element 66, or a dedicated sensor can be separately provided. Means for sensing vibration attributable to the drive of the drive element 66 can be provided for each of the nozzles 48, or can be provided to two or more of the nozzles 48. Also, means for sensing vibration attributable to the drive of the drive element 66 can be provided to the cavity 46, or can be provided to the supply port 44 or the reservoir 42. Also, the timing at which vibration attributable to the drive of the drive element 66 is detected is not limited to being after the drive of the drive element 66, and can instead be before the drive of the drive element 66, or can be simultaneous with this drive, or can be during this drive.

In the above working example, an inkjet printer that discharged ink was described as an example of a liquid discharge device, but the liquid discharged by the liquid discharge device of the invention is not limited to being ink, and can be any of various kinds of liquid, as well as a fluid in a state in which a solid is dispersed in a liquid or a gas. For example, the invention is not limited to an inkjet type of printer, and can also be applied to some other type of printer. It can also be applied to a discharge device that discharges a liquid-form substance, including when an electrode material, a colorant, or another such material is in a dispersed or dissolved state, and which is used in the manufacture of liquid crystal displays, organic electroluminescence displays, field emission displays (FED), and the like. It can also be applied to a discharge device that discharges a liquid containing a biological organic substance, and which is used in the manufacture of bio chips. It can also be applied to a discharge device that discharges a liquid that serves as a sample, and which is used as a precision pipette. It can also be applied to a discharge device that discharges a lubricating oil at a pinpoint to a clock, a camera, or another such piece of precision machinery, or to a discharge device that discharges a transparent resin liquid, such as a UV-curing resin, for forming a microscopic hemispherical lens (optical lens) used in optical communication elements. It can also be applied to a discharge device that discharges an etching liquid for etching a wafer, or to a discharge device that discharges a powder, such as a toner.

The entire disclosure of Japanese Patent Application No. 2011-133355, filed Jun. 15, 2011, is expressly incorporated by reference herein.

What is claimed is:

1. A liquid discharge device, comprising:

a discharge component for driving a drive element to discharge a liquid contained in a cavity from a nozzle that communicates with the cavity;

a detector for detecting residual vibration produced by the drive of the drive element; and a tester for testing the discharge component on the basis of a plurality of periods of vibration of the residual vibration.

2. The liquid discharge device according to claim 1, further comprising a maintenance component for servicing the discharge component according to test result produced by the tester.

3. The liquid discharge device according to claim 1, wherein the plurality of periods of vibration of the residual vibration include a first period and a second period that is longer than the first period, and the tester tests the discharge component on the basis of change from the first period to the second period.

4. The liquid discharge device according to claim 1, wherein the tester tests the discharge component on the basis of not only the periods of vibration of the residual vibration, but also the increase in the amplitude of the residual vibration during a change between the periods of vibration of the residual vibration.

5. The liquid discharge device according to claim 1, wherein the tester tests the discharge component on the basis of whether or not the changed period exceeds a second threshold, which is greater than a first threshold, after the period of the vibration of the residual vibration has dropped below the first threshold.

6. The liquid discharge device according to claim 1, wherein the tester tests the discharge component on the basis of the change in the period of the vibration of the residual vibration if the initial period in the residual vibration corresponds to a set period, and tests the discharge component on the basis of the initial period if the initial period is different from the set period.

7. A testing method for testing a discharge component that drives a drive element to discharge a liquid contained in a cavity from a nozzle that communicates with the cavity, the method comprising:

a detection step of detecting residual vibration produced by the drive of the drive element; and a testing step of testing the discharge component on the basis of a plurality of periods of vibration of the residual vibration.

8. A non-transitory medium for recording a program that causes a computer to carry out a function of testing a discharge component that drives a drive element to discharge a liquid contained in a cavity from a nozzle that communicates with the cavity, the medium being readable by a computer that has recorded a program for carrying out:

a detection function of detecting residual vibration produced by the drive of the drive element; and a testing function of testing the discharge component on the basis of a plurality of periods of vibration of the residual vibration.

* * * * *